US007268765B2

(12) United States Patent
Lim et al.

(10) Patent No.: US 7,268,765 B2
(45) Date of Patent: Sep. 11, 2007

(54) METHOD OF COLOR IMAGE DISPLAY FOR A FIELD SEQUENTIAL LIQUID CRYSTAL DISPLAY DEVICE

(75) Inventors: Moo-Jong Lim, Seoul (KR); Hyung-Ki Hong, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 20 days.

(21) Appl. No.: 09/988,650

(22) Filed: Nov. 20, 2001

(65) Prior Publication Data

US 2002/0093479 A1 Jul. 18, 2002

(30) Foreign Application Priority Data

Nov. 20, 2000 (KR) ..... 2000-69054

(51) Int. Cl.
*G09G 3/36* (2006.01)

(52) U.S. Cl. ..... 345/102; 345/690; 362/561

(58) Field of Classification Search ..... 345/87–89, 345/102–103, 204, 205, 690–693, 211; 349/61; 749/62, 64

See application file for complete search history.

(56) References Cited

U.S. PATENT DOCUMENTS 5,359,345 A * 10/1994 Hunter ..... 345/102
6,115,016 A * 9/2000 Yoshihara et al. ..... 345/88
6,570,554 B1 * 5/2003 Makino et al. ..... 345/102
6,573,882 B1 * 6/2003 Takabayashi ..... 345/102
6,873,311 B2 * 3/2005 Yoshihara et al. ..... 345/87
2002/0000960 A1 * 1/2002 Yoshihara et al. ..... 345/87

FOREIGN PATENT DOCUMENTS

JP 11-337904 12/1999

* cited by examiner

*Primary Examiner*—Henry N. Tran
(74) *Attorney, Agent, or Firm*—McKenna Long & Aldridge LLP

(57) ABSTRACT

A field sequential liquid crystal display device having a liquid crystal panel, a back light having multiple light sources (Red, Green and Blue) under the liquid crystal panel, and a signal processing circuit that controls the luminances of the light sources based on frame-based image signal data. The signal processing circuit decides luminance values (Ra, Ga, and Ba) to be displayed during sub-frames, and further decides the luminances of the light sources and/or the transmissivities of the liquid crystal during each sub-frame so as to produce the average illumination in the image signal data.

19 Claims, 8 Drawing Sheets

METHOD OF COLOR IMAGE DISPLAY FOR A FIELD SEQUENTIAL LIQUID CRYSTAL DISPLAY DEVICE

This application claims the benefit of Korean patent application No. 2000-69054, filed Nov. 20, 2000 in Korea, which is hereby incorporated by reference.

BACKGROUND OF THE INVENTION

1. Field of the Invention

The present invention relates to an active-matrix liquid crystal display (AM LCD) device, and more particularly, to a method of displaying a color image using a field sequential liquid crystal display. Although the present invention is suitable in many applications, it is particularly useful for improving field sequential liquid crystal displays so as to increase a range of luminance and to decrease power consumption.

2. Discussion of the Related Art

Until recently, a cathode-ray tube (CRT) has usually been used for displays. However, flat panel displays are becoming more common because of their small depth, low weight, and low power consumption. Thin film transistor-liquid crystal displays (TFT-LCDs) are currently undergoing development to improve their resolution and to reduce their depth.

Generally, a liquid crystal display (LCD) device includes an upper substrate, a lower substrate, and an interposed liquid crystal layer. The upper and lower substrates have opposing electrodes such that an electric field applied across those electrodes causes the molecules of the liquid crystal to align according to the electric field. By controlling the electric field, a liquid crystal display device can produce an image.

The active-matrix liquid crystal display (AM LCD) device is probably the most popular type of LCDs because an AM LCD has high resolution and superior moving image properties. A typical AM LCD has a plurality of switching elements and pixel electrodes that are arranged in a matrix on the lower substrate. Therefore, the lower substrate of an active-matrix liquid crystal display is often referred as an array substrate.

The structure of a conventional active-matrix liquid crystal display is described with reference to FIG. 1, which illustrates a cross-section of a pixel region. The active-matrix liquid crystal display 2 includes a liquid crystal panel 10 and a back light 50. The liquid crystal panel 10 includes a color filter substrate 20 and an array substrate 40 that face each other across a liquid crystal layer 30. On the color filter substrate 20 is a color filter layer 22 that includes a black matrix 22*a* (for preventing light leakage) and color sub-filters 22*b*, including red (R), green (G), and blue (B) sub-filters. The color filter substrate 20 also includes a common electrode 24, which is one of the electrodes used in applying a voltage across the liquid crystal layer 30.

Still referring to FIG. 1, a thin film transistor, which functions as a switching element, and a pixel region are formed on the array substrate 40. The thin film transistor and the pixel region are disposed across from the color filter substrate 20. A pixel electrode 42 electrically connects to the thin film transistor (which is formed in the region T). The pixel electrode 42 functions as the other electrode used for applying voltage across the liquid crystal layer 30. The pixel electrode 42 is located in the pixel region "P". A back light 50 is disposed under the array substrate 40. The back light radiates light onto the liquid crystal panel 10. The back light

50 includes a light source 52 and a plurality of panels 54 that uniformly radiating light from the light source 52 onto the liquid crystal panel 10.

The liquid crystal display device 2 uses optical anisotropy and polarization properties of the liquid crystal molecules to produce a desired image. That is, by applying a voltage across the liquid crystal molecules (which have a long, thin structure and which have a pretilt angle) the alignment of the liquid crystal molecules changes. Thereafter, light from the back light 50 is polarized by the optical anisotropy of the liquid crystal. That polarized light is then controllably passed through the color filter layer to produce a color image.

Refer now to FIG. 2 for another view of a liquid crystal display. As shown, the liquid crystal panel 10 includes the array substrate 40, the color filter substrate 20, and the interposed liquid crystal layer 30. A plurality of gate bus lines 46 are horizontally arranged, and a plurality of data bus lines 48 are vertically arranged on the array substrate 40. Those bus lines define a plurality of pixels (between the bus lines). Thin film transistors "T" are formed near the intersections of the gate bus lines 46 and the data bus lines 48. A pixel electrode 42 within each pixel region is connected to an associated thin film transistor "T". The common electrode 24 and the color filter layer 22 (with the color sub-filters) are formed on the color filter substrate 20.

In the conventional liquid crystal display device described above, the process for displaying a color image is as follow. First, liquid crystal alignment is changed by applying a voltage across each pixel of the liquid crystal layer. The incident light from the back light is polarized by irradiating it through the liquid crystal having the aligned liquid crystal. Then, a color image pixel is produced by passing the polarized light through the color sub-filters red (R), green (G), and blue (B). Therefore, in the conventional liquid crystal display device it is necessary to include red (R), green (G), and blue (B) color sub-filters to produce a color image.

The color filter layer is typically manufactured using either a dye-method (in which a dye resin is formed on a transparent substrate) or a pigment-spraying method (in which a pigment is sprayed on a transparent substrate). However, those methods have problems. First, the materials used are expensive, and the methods tend to consume a lot of those materials. The results is a relatively high manufacturing cost. Second, the materials that are used have a maximum light transmissivity of about 33%, necessitating a bright back light to effectively display a color image. Such a bright back light results in relatively high power consumption. Furthermore, if the color filter layer is thick, the color properties are improved, but the light transmissivity is reduced. On the other hand, if the color filter is thin, the light transmissivity is improved, but the color properties are poor. Therefore, a manufacturing process having great precision is required. However, since such is not available, the result is a low production yield and an inferior product.

Many studies and experiments have been performed to enable a full color display that does not require a color filter. While such studies and experiments had not proven commercially successful, the development of new liquid crystal modes, such as Ferroelectric Liquid Crystal (FLC), Optical Compensated Birefringent (OCB), field sequential, and Twisted Nematic (TN) displays open new possibilities in producing full color displays.

The structure of the field sequential liquid crystal display device is explained with reference to FIG. 3, which illustrates a part of a field sequential liquid crystal display device. As shown, a field sequential liquid crystal display device includes a common electrode substrate 65 and an array substrate 80 that are spaced apart in a facing relationship. A liquid crystal layer 70 is disposed between the common electrode substrate 65 and the array substrate 80. A plurality of gate bus lines 82 is horizontally arranged, while a plurality of data bus lines 84 is vertically arranged on the array substrate 80. Those bus lines define a plurality of pixels. Thin film transistors are formed at the intersections of the gate bus lines 82 and the data bus lines 84. Furthermore, a pixel electrode 86 that is connected to a thin film transistor is in each pixel region.

As shown in the circle of FIG. 3, each thin film transistor "T" is a switching element having a gate electrode "G", a source electrode "S" and a drain electrode "D". The gate electrode "G" is connected to a gate line 82, the source electrode "S" is connected to a data line 84, and the drain electrode "D" is connected to a pixel electrode 86. A common electrode 66 is formed on the common electrode substrate 65. However, unlike in the LCD shown in FIGS. 1 and 2, the common electrode substrate 65 does not have a color filter. Still referring to FIG. 3, a back light 90 is disposed under the liquid crystal panel 60. That back light radiates light onto the liquid crystal panel 60. The back light 90 of the field sequential liquid crystal display device has three different light sources, which can produce three different colors of light, red (R) 94*a*, green (G) 94*b*, and blue (B) 94*c*. Additionally, a plurality of panels 92 ensures uniform dispersion of light from the back light (R, G, and B) onto the liquid crystal panel. The field sequential liquid crystal display device further includes an external driving circuit for applying signals to produce a desired image. The external driving circuit includes a gate scan input driver 98 that apples electric pulses to the horizontal gate bus lines 82 and a data input driver 96 for applying image signals to vertical data bus lines 84.

The back light 90 can be two different kinds. One, as shown in FIG. 4*a*, is a wave guide mode back light in which Red, Green and Blue light sources are disposed in a lower corner of the array substrate 80. The other, as shown in FIG. 4*b*, has Red, Green and Blue light sources disposed directly under the array substrate 80 in a repeated ordering of Red, Green and Blue.

A color image display and driving method for a field sequential liquid crystal display device will be explained with reference to FIGS. 3 and 5. FIG. 5 illustrates a flow chart of a method of producing a color image using a conventional field sequential liquid crystal display device. Initially, frame-based image signals are input from a data input driver onto the data bus lines. Each frame-based image signal is comprised of first, second and third sub-frame image signals that are related to Red, Green and Blue color images that are to be produced in respective sub-frames. Those sub-frame image signals selectively turn on the thin film transistors during a sub-frame so as to align the liquid crystal in each sub-frame periods. With the liquid crystal properly aligned the light source associated with that sub-frame (Red, Green, and Blue) is then turned on and off to produce an image. The overall perception of the three sub-frames produces a color frame.

Thus, in a field sequential liquid crystal display device the frame-based image signals include signals for three light colors (Red, Green and Blue), and each color image signal is applied during a sub-frame period. Further, the liquid crystal molecules are arranged during each sub-frame by selectively turning on the thin film transistors. By properly sequencing turning on and off the light sources with the sub-frame liquid crystal molecule alignment a color image is produced during each frame. Because the Red, Green and Blue images in each frame appear to be blended together, when observed a color image results.

The foregoing will be explained in more detail. Referring now to FIG. 5, Red image signals are applied to the data bus lines by the data input driver 96 during a first sub-frame period (which is one-third of a full frame period). At the same time the gate scan input driver 98 selectively applies gate pulse voltages to the gate line. Namely, as shown in FIG. 3, when a gate pulse voltage is applied to the gate line $G_i$, the thin film transistors connected to that gate line are turned on in accord with the intensity or the pulse width of the gate pulse voltage. Reference step 100 of FIG. 5. Because the turned-on thin film transistors connect to the data lines, the Red component image signals from the data input driver are applied across the liquid crystal cells associated with the turned-on thin film transistors. Charges accumulate across those liquid crystal cells, which then arrange the liquid crystal molecules, reference step 105 of FIG. 5. Then, a gate pulse voltage is applied to the gate line $G_{i+1}$, which causes the thin film transistors connected to the gate line $G_{i+1}$ to turn on, causing charges to accumulate across their liquid crystal cells. Furthermore, the thin film transistors connected to the gate line $G_i$ are turned off and their accumulated charges are stored until the gate line $G_i$ is driven during the next sub-frame. When all of the thin-film transistors have turned on, the liquid crystal molecules are properly aligned. Thereafter, the Red light source of the back light is turned on and off (in step 110) to produce a Red component of an image (in step 115). The first sub-frame is then complete.

Next, during the second sub-frame Green image signals are applied to the data bus lines by the data input driver 96. At the same time the gate scan input driver 98 selectively applies gate pulse voltages to a gate line. Namely, as shown in FIG. 3, when a gate pulse voltage is applied to the gate line $G_i$, the thin film transistors connected to that gate line are turned on in accord with the intensity or the pulse width of the gate pulse voltage. Reference step 120 of FIG. 5. Because the turned-on thin film transistors connect to the data lines, the Green component image signal voltages from the data input driver are applied across the liquid crystal cells associated with the turned-on thin film transistors. Charges then accumulate across those liquid crystal cells, which then arrange the liquid crystal molecules, reference step 125 of FIG. 5. After the Green image signals are all accumulated and the liquid crystal is properly aligned, the Green light source of the back light is turned on and off (in step 130). Thus a Green component of the image is produced during the second sub-frame (in step 135).

Finally, during the third sub-frame Blue image signals are applied to the data bus lines by the data input driver 96. At the same time the gate scan input driver 98 selectively applies gate pulse voltages to a gate line. Namely, as shown in FIG. 3, when a gate pulse voltage is applied to the gate line $G_i$, the thin film transistors connected to that gate line are turned on in accord with the intensity or the pulse width of the gate pulse voltage. Reference step 140 of FIG. 5. Because the turned-on thin film transistors connect to the data lines, the Blue component image signal voltages from the data input driver are applied across the liquid crystal cells associated with the turned-on thin film transistors. Charges then accumulate across those liquid crystal cells, which arrange the liquid crystal molecules, reference step 145 of FIG. 5. After the Blue image signals are all accumulated and the liquid crystal is properly aligned the Blue light source of the back light is turned on and off (in step 150), and thus a Blue component of the image is displayed during the third sub-frame (in step 155).

The period of one frame is typically one-sixtieth of a second. Thus, each sub-frame is one-third of one frame period, i.e., one-one hundred eightieth of a second. As explained previously the Red, Green and Blue image components are sequentially displayed so as to be perceived as a composite color image by an observer. As an example, if a white image is to be displayed, each of the Red, Green and Blue image components has the same luminance. Thus, a white image can be displayed by mixing image components having the same intensity together. The luminance of the displayed image of a field sequential liquid crystal display device depends on the luminance of the back light. That luminance in turn depends on the transmissivity of the elements constituting the liquid crystal panel and the transmissivity of the liquid crystal layer. That is, each light source passes through the liquid crystal panel and each is polarized by the liquid crystal layer. Thus, the luminance of each light source (Red, Green and Blue) is diminished by the transmissivity of the liquid crystal panel and the transmissivity of the liquid crystal layer (which is varied by the alignment of the liquid crystal molecules).

Because the transmissivity of the liquid crystal panel has a specific value determined by the elements constituting the liquid crystal panel, and because the back light has only two luminance values (corresponding to turned-on and turned-off), the luminance of an image displayed on the liquid crystal display screen is controlled by the transmissivity of the liquid crystal, which depends on the alignment of the liquid crystal molecules. Therefore, the luminance range of the conventional field sequential liquid crystal display device is relatively limited. Additionally, the overall power consumption when driving the back light is relatively high because each light source (Red, Green and Blue) is turned on and off to produce the same luminance.

SUMMARY OF THE INVENTION

Accordingly, the present invention is directed to a method of producing a color image using a field sequential liquid crystal display device, with that method substantially addressing one or more of problems due to limitations and disadvantages of the related art.

An object of the present invention is to provide an improved signal processing circuit for a field sequential liquid crystal display device.

Another object of the present invention is to provide a color image display method that increases the displayable luminance of the Red, Green and Blue images, and to decrease power consumption in field sequential liquid crystal display devices.

Additional features and advantages of the invention will be set forth in the description that follows and in part will be apparent from that description, or may be learned by practice of the invention. The objectives and other advantages of the invention will be realized and attained by the structure particularly pointed out in the written description and claims hereof, as well as the appended drawings.

To achieve these and other advantages and in accordance with the principles of the present invention, as embodied and broadly described, a field sequential liquid crystal display device comprises a liquid crystal panel having an upper substrate, a lower substrate, and an interposed liquid crystal layer. A back light is disposed under the lower substrate. That back light radiates light onto the liquid crystal panel using three different light sources (beneficially Red, Green and Blue). A signal processing circuit is electrically connected to each of light sources (Red, Green and Blue). That signal processing circuit controls the luminance of each light source (Red, Green and Blue). Each of the light sources (Red, Green and Blue) is beneficially disposed at a lower corner of the liquid crystal panel. In addition, each light source (Red, Green and Blue) of the back light is disposed under the liquid crystal panel.

In another aspect, the present invention provides a method of displaying a color image using a field sequential liquid crystal display device having upper and lower substrates and an interposed liquid crystal layer. A back light is disposed under the lower substrate. That back light includes Red, Green and Blue light sources. A signal processing circuit is electrically connected to each light source (Red, Green and Blue) and to the liquid crystal layer. A data input driver applies image signal data to the signal processing circuit during each frame. The method includes the steps of applying the image signal data to the signal processing circuit, obtaining luminance values Ra, Ga, and Ba of an image to be displayed during each sub-frame, dividing a frame into three sub-frames, each sub-frame beneficially having a period equal to one-third of a frame period, and displaying the obtained luminance values Ra, Ga and Ba in their respective sub-frames.

The sub-frame period includes a response time for the liquid crystal, and turn-on and turn-off times for the selected light sources (Red, Green and Blue).

When the image signal data is displayed, the luminances Ra, Ga and Ba in each sub-frame have an average value. The average luminance Ra, Ga and Ba may be produced by controlling the luminance of the light sources (Red, Green and Blue) and/or by controlling the alignment direction of the liquid crystal molecules. If the transmissivities of the liquid crystal during each sub-frame are defined as Tr, Tg, and Tb, and if the luminance of each light source (Red, Green and Blue) after alignment of the liquid crystal are defined as Rx, Gy and Bz, and if the inherent luminance of the liquid crystal panel is defined as Tk, the average luminance Ra, Ga and Ba can be expressed as follows.

$$Rx\times(Tr\times Tk)=Ra$$

$$Gy\times(Tg\times Tk)=Ga$$

$$Bz\times(Tb\times Tk)=Ba$$

Moreover, when one of the average luminances Ra, Ga, and Ba is greater than the average value of Ra, Ga, and Ba, the transmissivity of the liquid crystal, which depends on the alignment direction of the liquid crystal molecules, and the luminance of the light source during the sub-frame producing an image having the greater luminance, may be set at maximum values. The alignment direction of the liquid crystal and the luminance of the back light beneficially can be controlled by varying an electric potential.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and which are incorporated in and constitute a part of this specification, illustrate embodiments of the invention and together with the descriptions serve to explain the principles of the invention. In the drawings.

DETAILED DESCRIPTION OF THE ILLUSTRATED EMBODIMENT

Reference will now be made in detail to the illustrated embodiment of the present invention, which is shown in the accompanying drawings.

Figure 6:
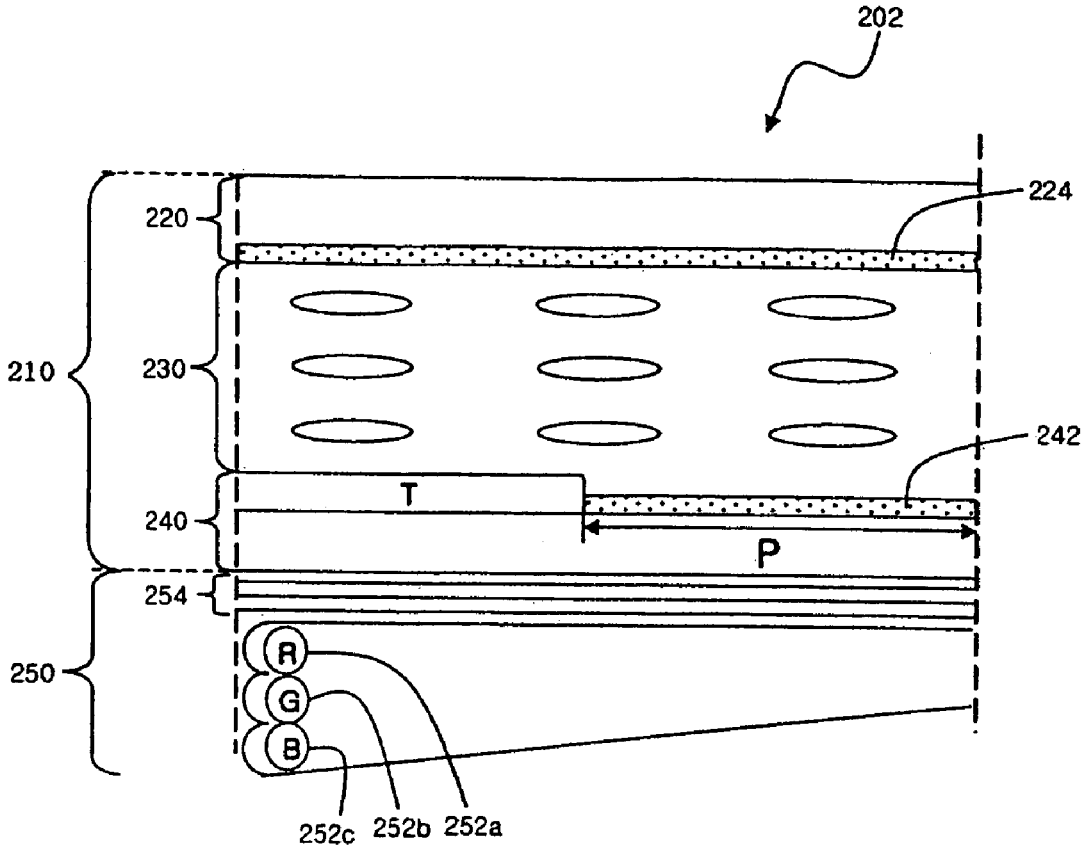
FIG. 6 is a cross-sectional view of a pixel of a field sequential liquid crystal display device according to the present invention.

In FIG. 6, a field sequential liquid crystal display device 202 according to the present invention includes a liquid crystal panel 210 and a back light 250. The liquid crystal panel includes a common electrode substrate 220, an opposing array substrate 240, and an interposed liquid crystal layer 230. A common electrode 224, which functions as an electrode for applying a voltage across the liquid crystal layer 230, is on the common electrode substrate 220. Thin film transistors "T", which function as switching elements, and pixel regions "P" are formed on the array substrate 240. A pixel electrode 242 is in each pixel region "P". Each pixel electrode 242, which is electrically connected to a thin film transistor "T", functions as another electrode for applying a voltage across the liquid crystal layer 230.

Figure 1:
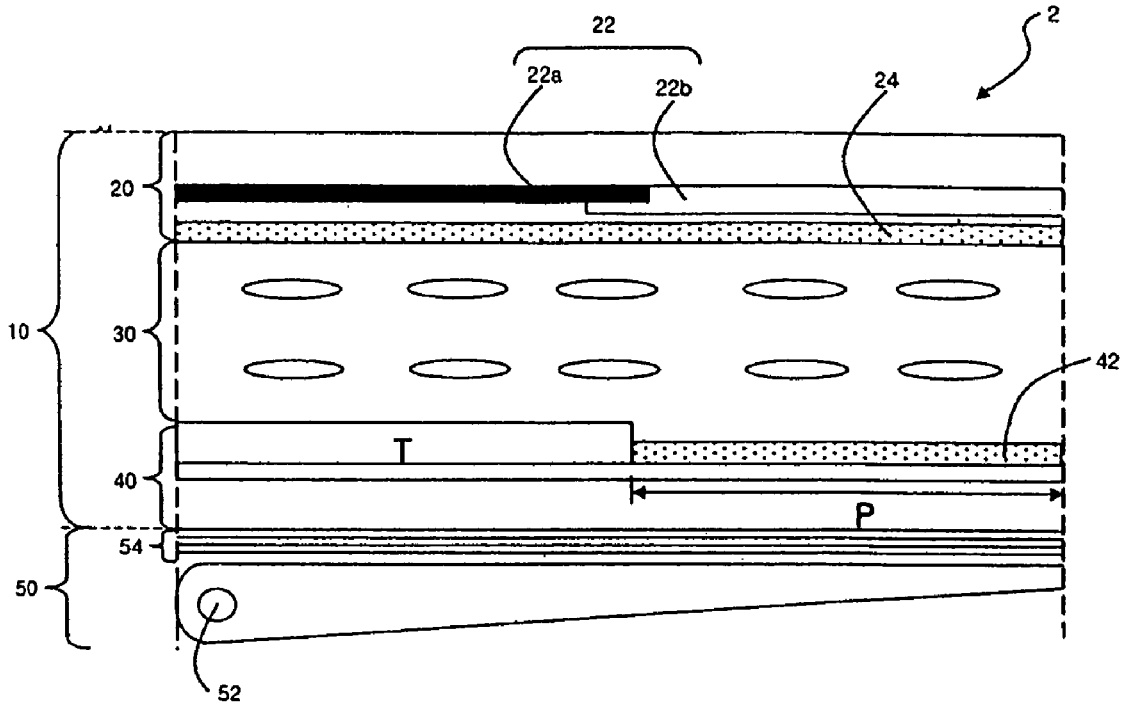
FIG. 1 (RELATED ART)
FIG. 1 is a cross-sectional view showing a pixel of a conventional liquid crystal display device.
Figure 2:
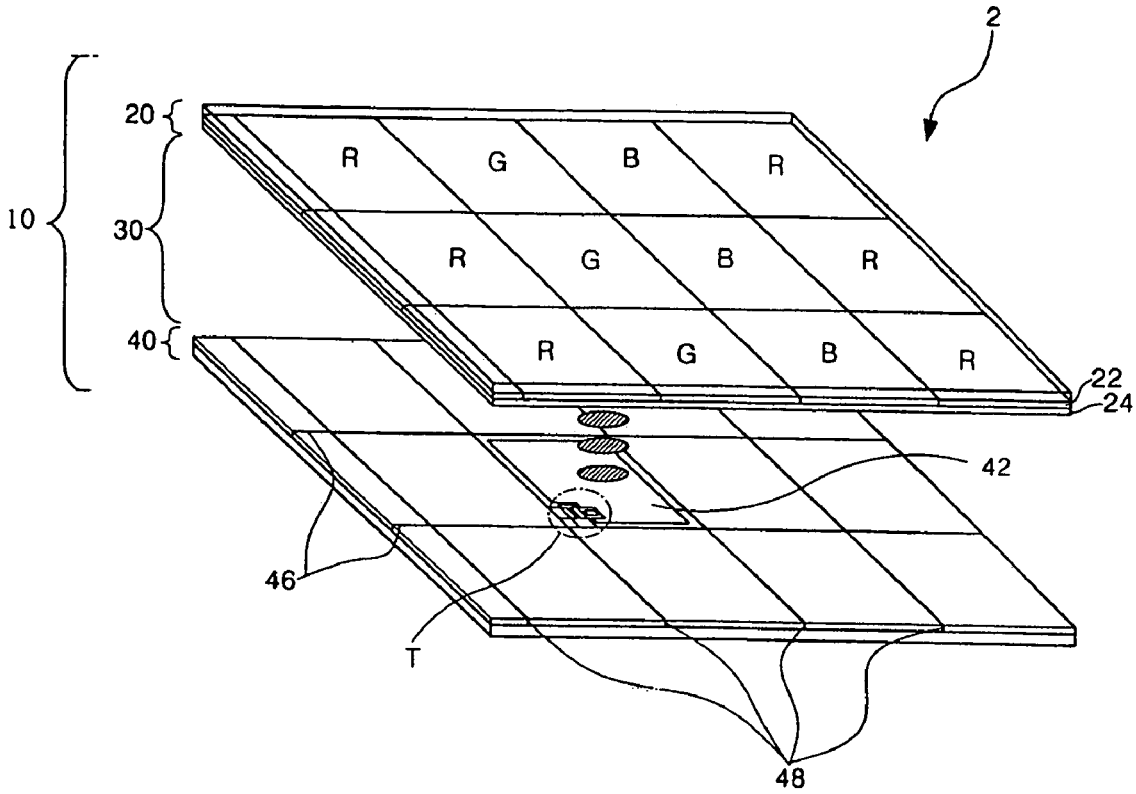
FIG. 2 (RELATED ART)
FIG. 2 is a perspective view showing a liquid crystal panel of a conventional liquid crystal display device.
Figure 3:
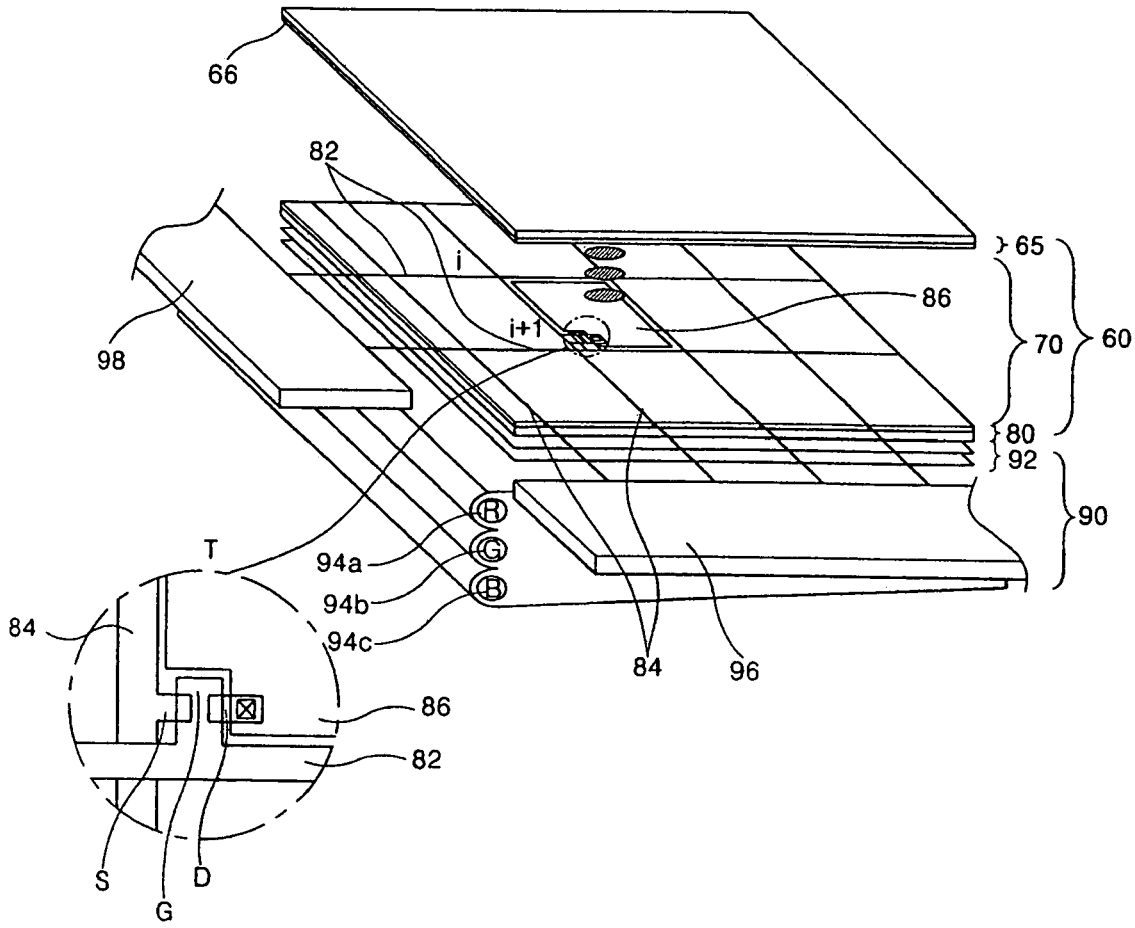
FIG. 3 (RELATED ART)
FIG. 3 is a perspective view showing part of a conventional field sequential liquid crystal display device.
Figure 4A:
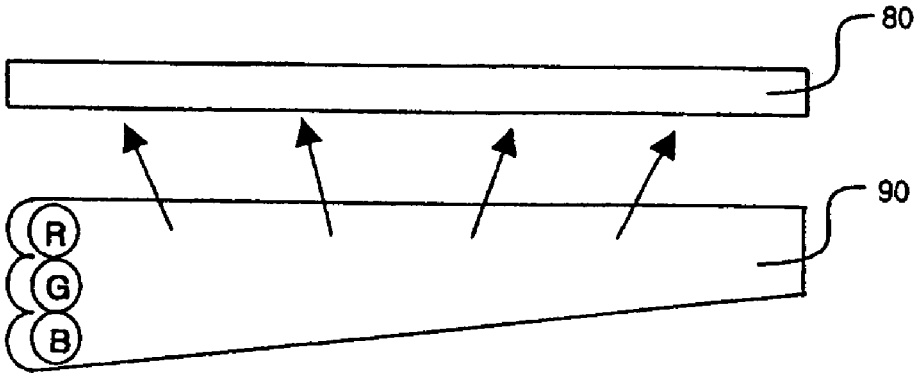
FIG. 4A (RELATED ART)
FIGS. 4A and 4B are views showing, respectively, a wave guide mode back light and a directly underneath mode back light in field sequential liquid crystal display devices.
Figure 4B:
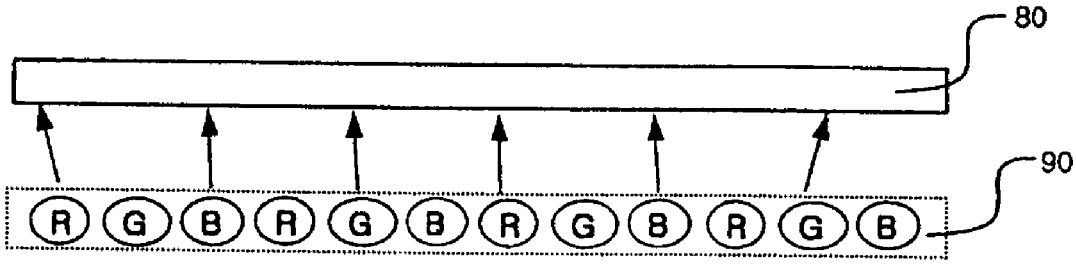
FIG. 4B (RELATED ART)
Figure 5:
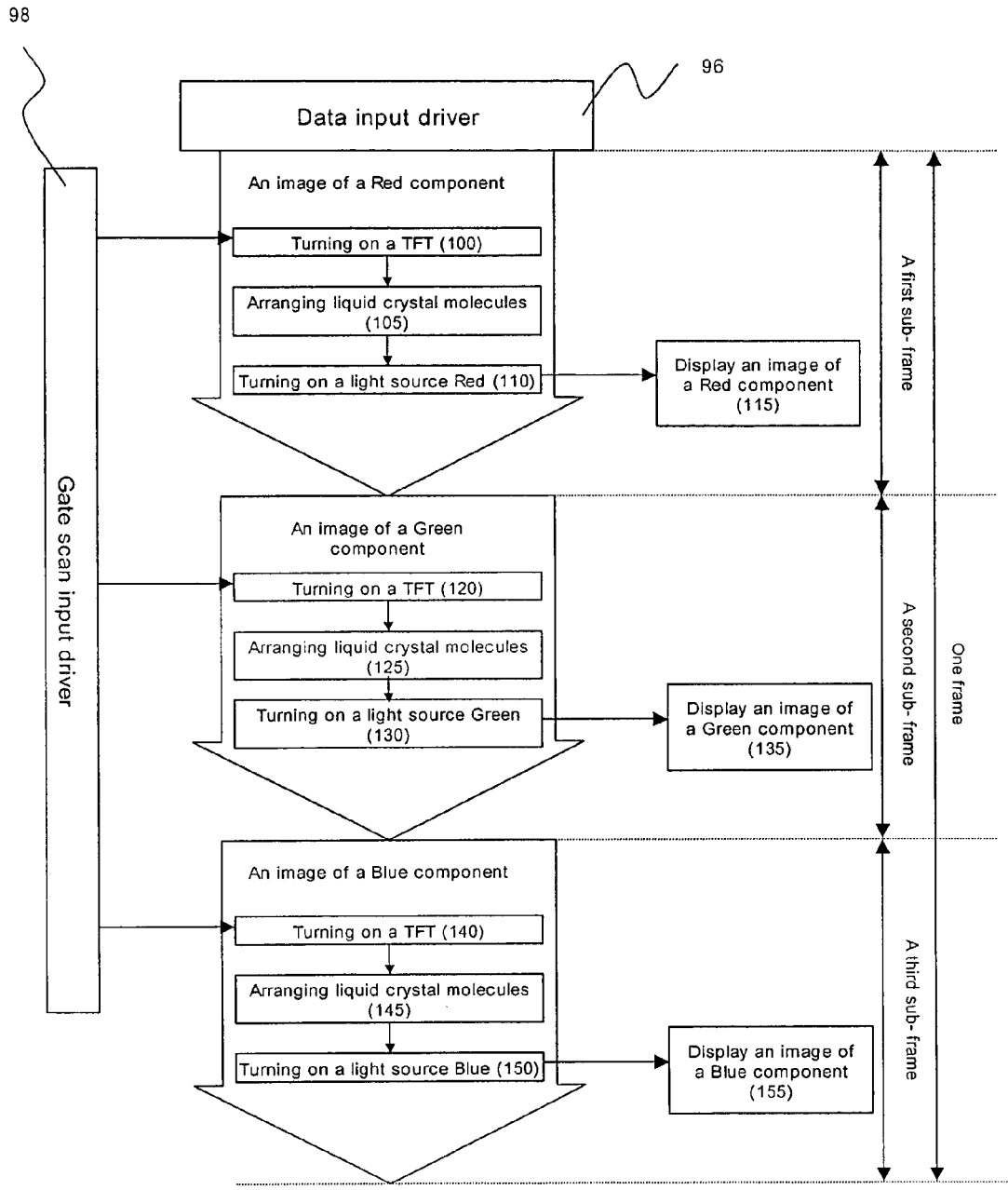
FIG. 5 (RELATED ART)
FIG. 5 is a flow chart illustrating a method of producing a color image using a conventional field sequential liquid crystal display device.

The back light 250 is disposed under the liquid crystal panel 210. The back light radiates light onto the bottom of the liquid crystal panel 210. The back light 250 is comprised of a light source 252 and a plurality of panels 254 for uniformly dispersing light onto the liquid crystal panel 210. The back light 250 light source 252 includes three light sources, Red (252*a*), Green (252*b*) and Blue (252*c*). While FIG. 6 illustrates a wave guide mode back light, the principles of the present invention also apply to directly underneath mode back lights (reference FIG. 4*b*). However, wave guide mode back lights are desirable because they tend to reduce costs.

Figure 7:
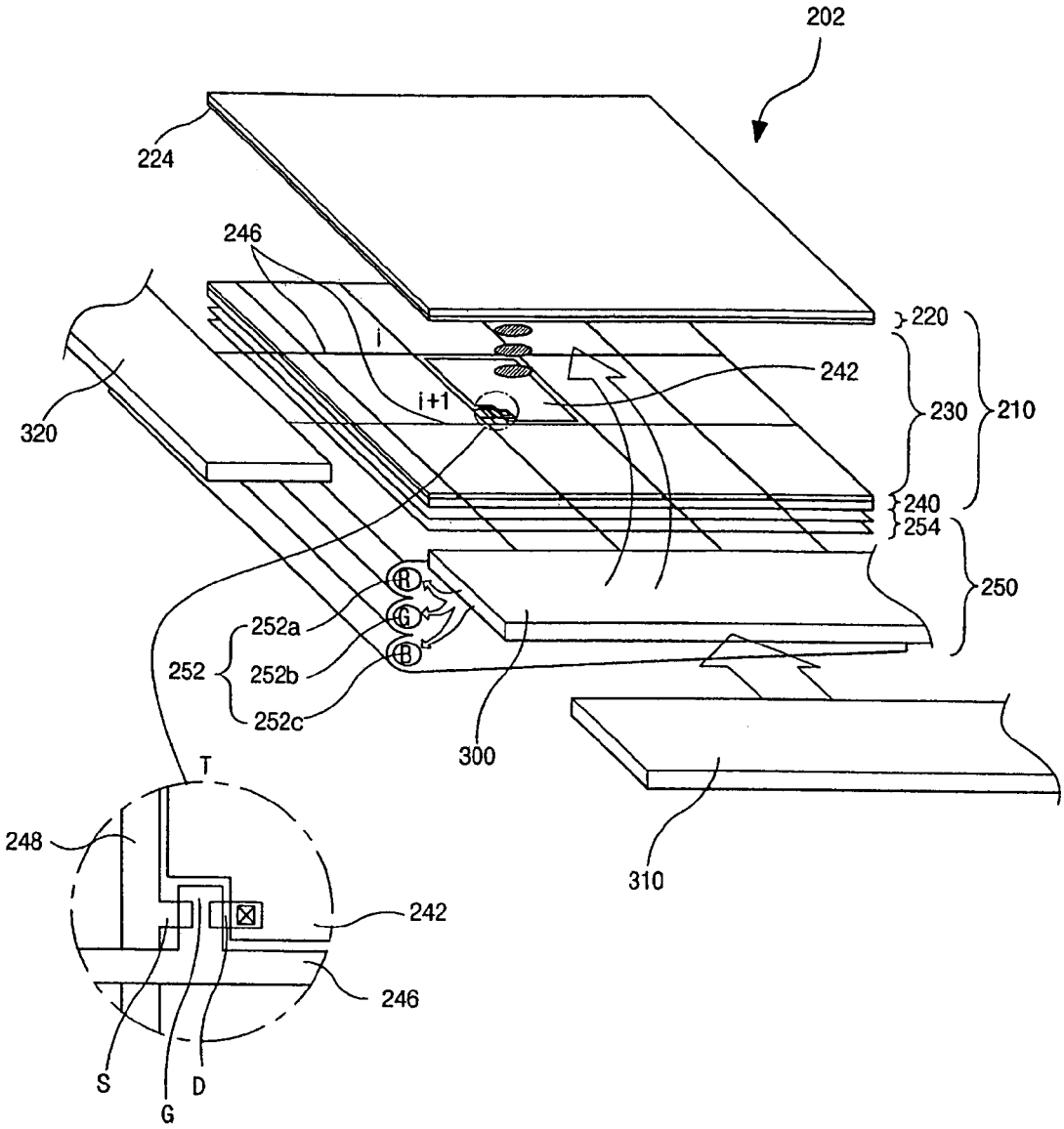
FIG. 7 is a perspective view showing part of a field sequential liquid crystal display device according to the present invention.

FIG. 7 is a perspective view showing a part of a field sequential liquid crystal display device according to the principles of the present invention. As previously described, the common electrode substrate 220 and the array substrate 240 are opposed and the liquid crystal layer 230 is interposed therebetween. A plurality of horizontal gate bus lines 246 and a plurality of vertical data bus lines 248 are formed on the array substrate 240. The pixel regions "P" are defined where the bus lines cross. The thin film transistors "T", which function as switching elements, are formed at the intersections of the gate bus lines 246 and the data bus lines 248. Again, the pixel electrodes 242 electrically connect to the thin film transistors "T". As shown in the circle, each thin film transistor "T" switching element includes a gate electrode "G", a source electrode "S", and a drain electrode "D". The gate electrode "G" is connected to a gate line 246, the source electrode "S" is connected to a data line 248, and the drain electrode "D" is connected to a pixel electrode 242. The common electrode 224, which electrically corresponds to the pixel electrode 242 on the array substrate 240, is formed on the common electrode substrate 220. A liquid crystal layer 230 is disposed between the array substrate 240 and the common electrode substrate 220. The back light 250 with three light sources (Red, Green and Blue) is disposed under a liquid crystal panel 210 so as to irradiate light onto the liquid crystal panel. A plurality of panels 254 uniformly disperse light from the light sources (Red, Green, and Blue) onto the liquid crystal panel.

An external driving circuit applies image signal data. The external driving circuit includes a signal processing circuit 300 that is electrically connected to the data bus lines 248, to the liquid crystal 230, and to the light sources (Red, Green and Blue). A data input driver 310 applies image signal data to the signal processing circuit 300. A gate scan input driver 320 selectively applies gate pulse voltages to the gate bus lines 236 for scanning. The present invention uses the line sequential driving method to produce an image (previously described). That method has the signal processing circuit 300 decode the image signal data so as to enable an increase in the range of luminance by controlling (1) the transmissivity of the liquid crystal (which depends on the alignment direction of the liquid crystal molecules) and (2) the luminance of the light sources (Red, Green and Blue).

In practice, the present invention may be diversely embodied according to the method of controlling the transmissivity of the liquid crystal, which depends on the alignment direction of the liquid crystal molecules and the luminance of the light sources (Red, Green and Blue).

Figure 8:
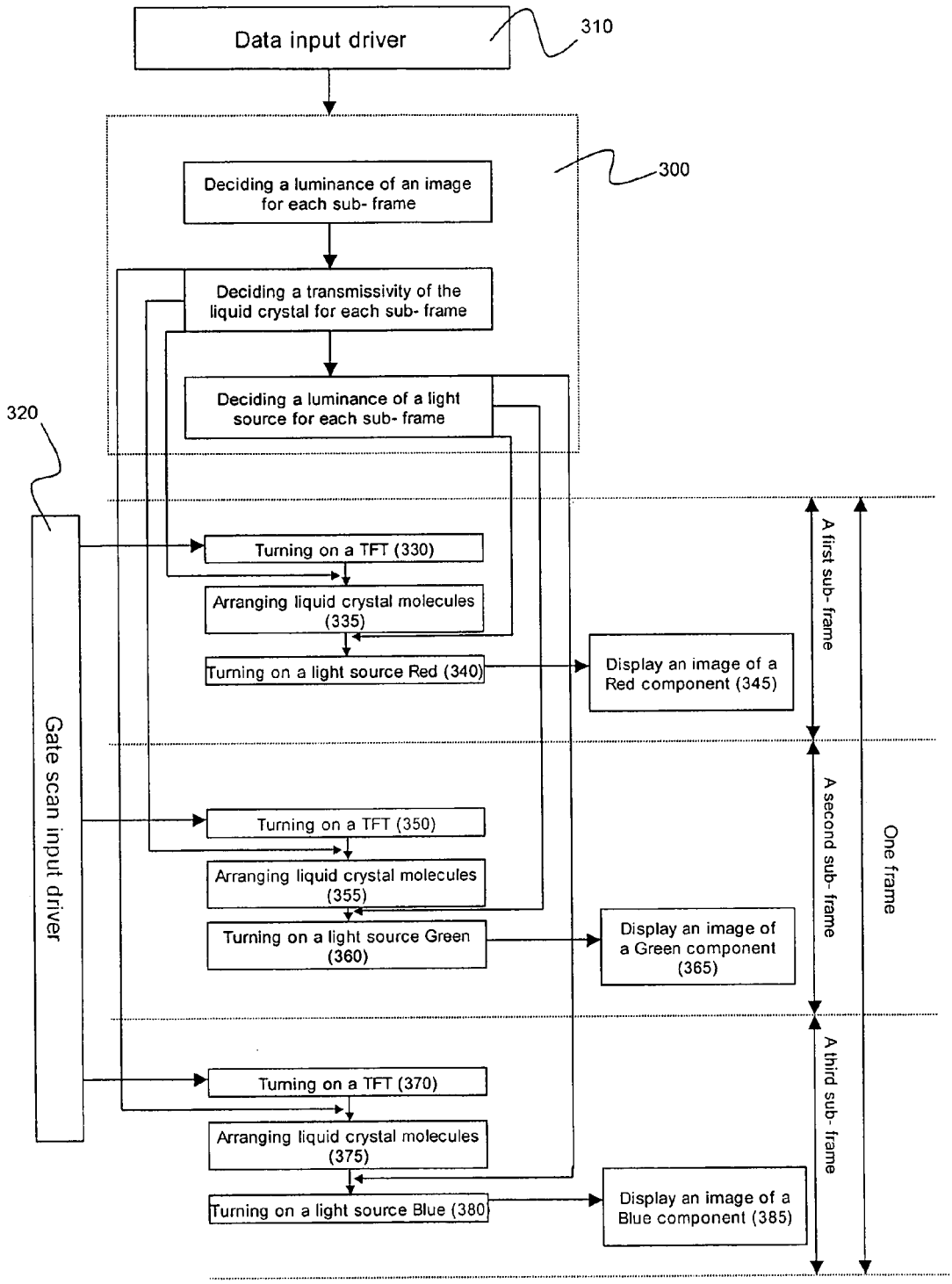
FIG. 8 is a flow chart illustrating a method of displaying a color image using a field sequential liquid crystal display device according to the present invention.

A first embodiment of the present invention is a field sequential liquid crystal display device having a signal processing circuit that can produce an image having an average luminance determined from image signal data. In FIG. 7 and FIG. 8, image signal data having image information for one frame is applied to the signal processing circuit 300 through the data input driver 310. Thereafter, the signal processing circuit decides an average luminance of the image to be displayed during each sub-frame by analyzing the image signal data.

If the luminance values displayed in each sub-frame are defined as Ra, Ga and Ba, an average luminance value "A" of one frame, after sequential display of each sub-frame, has a value that depends on the luminance of each sub-frame. Each of the luminances Ra, Ga and Ba displayed during each sub-frame can be controlled by the signal processing circuit controlling (1) the luminance of the light sources (Red, Green and Blue) of the back light and (2) the liquid crystal alignment. Those elements can be controlled by varying electric signals. Namely, the luminance of an image produced in each sub-frame depends on the luminance of the light source used in that sub-frame, the inherent transmissivity of the liquid crystal panel, and the transmissivity of the liquid crystal, which depends on its alignment (that being the alignment direction of the liquid crystal molecules). If the transmissivities of the liquid crystal are defined as Tr, Tg, and Tb, and if the luminance of each light source (Red, Green and Blue) of the back light are defined as Rx (Red), Gy (Green), and Bz (Blue), and if the inherent transmissivity of the liquid crystal panel is defined as Tk, the average luminance values Ra, Ga and Ba are as follows.

$$Rx\times(Tr\times Tk)=Ra$$

$$Gy\times(Tg\times Tk)=Ga$$

$$Bz\times(Tb\times Tk)=Ba$$

Because the inherent transmissivity of the liquid crystal panel has a fixed value, the luminance of the image displayed during each sub-frame is controllable using the luminance of the light source and the transmissivity of the liquid crystal. Therefore, a desired luminance value (Ra, Ga or Ba) produced during a particular sub-frame can be attained by controlling (1) the luminance (Rx, Gy and Bz) of the light source used during that sub-frame and (2) by controlling the transmissivity (Tr, Tg and Tb) of the liquid crystal.

For example, if an image having a luminance value of 50 ($R_{50}$) is to be displayed during a first sub-frame using a Red light source having a luminance of 200 ($R_{200}$), the multiplication value of the transmissivity of the liquid crystal together with the inherent transmissivity of the liquid crystal panel (Tr×Tk) should be 25%. If the luminance of the light source Red is 100 ($R_{100}$), an image having the same luminance value of 50($R_{50}$) can be displayed by setting the multiplication value of the transmissivity of the liquid crystal together with the inherent transmissivity of the liquid crystal panel (Tr×Tk) to 50%.

Turning now specifically to FIG. 8., a data input driver 310 applies image information to the signal processing circuit 300. The signal processing circuit 300 then decides, based on the image information, the luminance of the image to be produced during each sub-frame. Then, the signal processing circuit 300 decides (1) the required transmissivity of the liquid crystal during each sub-frame, and (2) the required luminance of the light source used during that sub-frame so as to produce an image having an luminance that corresponds to the luminance in the image signal data from the data input device 310. Beneficially, those determinations compensate for the inherent transmissivity of the liquid crystal panel.

With the foregoing information, the thin film transistors are operated (turned on) reference step 330 of FIG. 8, to properly arrange the liquid crystal molecules to attain the required transmissivity of the liquid crystal, reference step 335 of FIG. 8. Subsequently a light source (Red) is driven (turned on, reference step 340 of FIG. 8) to produce an image having a red component (reference step 345 of FIG. 8) with the decided luminance. That is, the thin film transistors selected using a line sequential driving method are turned on by the gate scan input driver 320 (step 330) to arrange the liquid crystal molecules (step 335) connected to the thin film transistor to attain the transmissivity of the liquid crystal decided by the signal processing circuit. An electric signal is then applied to arrange the liquid crystal molecules. Then, the Red light source, which is set to produce the luminance decided by the signal processing circuit, is turned on and off (step 340) to display an image having the luminance Ra (step 345).

In the second sub-frame, an image having a desired luminance value is displayed using the same process as that of the first sub-frame. That is, the thin film transistors are turned on (step 350) and the liquid crystal is properly arranged (step 355). Then, the Green light source, after being set to produce the desired luminance, is turned and off (step 360), and an image having a luminance Ga is displayed (step 365).

In the third sub-frame, the thin film transistors are also turned on (step 370) and the liquid crystal molecules are arranged (in step 375) to have the transmissivity decided by the signal processing circuit. Then, the light source Blue, after being set to produce the luminance decided by the signal processing circuit, is turned and off (step 380). The result is an image having a luminance Ba (in step 385).

The composite color image for a frame is produced by sequentially going through the foregoing processes. An image produced according to the principles of the present invention has the same perceived luminance as the average luminance contained in the image signal data from the data input driver. There may be many different combinations of liquid crystal transmissivities and light source luminances that will produce an image having the average luminance contained in the image signal data. However, the liquid crystal transmissivity and light source luminance have a one-to-one correspondence to produce a particular perceived luminance. A low luminance back light value may be selected, and then the transmissivity of the liquid crystal can be controlled to display the desired image.

A second embodiment of the present invention relates to a method of using light source luminances and liquid crystal transmissivity to emphasize a specific color when a specific color is emphasized in the image signal data. That is, if the image signal data (Red, Green and Blue) from the data input driver 310 emphasizes a particular color, the signal processing circuit controls the luminances of the light sources (Red, Green and Blue) of the back light, and the transmissivity of the liquid crystal, to emphasize that particular color. Details of the second embodiment processes will be described with reference to FIG. 7 and FIG. 8.

Image signal data for a frame is applied to the signal processing circuit 300 from the data input driver 310. The signal processing circuit 300 detects an emphasized color in the image signal data. The signal processing circuit then decides the luminances of the images to be produced during each sub-frame. The signal processing circuit can decide to raise the luminance of the light source and the transmissivity of the liquid crystal in the sub-frame for the emphasized color, and/or the signal processing circuit can decide to lower the light source luminance and transmissivity in the sub-frames of the other colors. Either way, a particular color is emphasized.

For example, if Red is emphasized in the image signal data the Red light source of the back light can be turned on and off during the first sub-frame with the transmissivity of the liquid crystal increased. Then, during the second and third sub-frames the transmissivities of the liquid crystal can be lowered. The result is that Red is emphasized. In addition, if a color comprised of a combination of more than one color is to be emphasized, such as Yellow, the combined color (Yellow) can be emphasized during a frame by raising the luminance of the light sources (Green and Blue) and/or the transmissivities of the liquid crystals in the sub-frames that make up that color (Green and Blue).

Thus, when the signal processing circuit detects an emphasized color in the image signal data, the luminances of the light sources of the back light and/or the transmissivities of the liquid crystal during the sub-frame related to the emphasized color, are increased. Alternatively, the luminances of the light source of the back light and/or the transmissivities of the liquid crystal during the sub-frame that are irrelevant to the emphasized color are decreased. Power consumption for driving the back light can be reduced by turning the light source of the back light on and off with a reduced luminance. The luminance of the light sources of the back light can beneficially be controlled by varying an electric current.

It will be apparent to those skilled in the art that various modifications and variations can be made in the method of color image display of the present invention without departing from the spirit or scope of the invention. Thus, it is intended that the present invention cover the modifications and variations of this invention provided they come within the scope of the appended claims and their equivalents.

What is claimed is:

1. A field sequential liquid crystal display device, comprising:

a liquid crystal panel having an upper substrate, a lower substrate, and an interposed liquid crystal layer;

a data input driver;

a back light under the lower substrate for irradiating light onto the liquid crystal panel, said back light including at least three light sources; and a signal processing circuit connected to an output of the data input driver and to the light sources, wherein the signal processing circuit is to directly control a luminance level of each of the light sources based upon image data from the data input driver, wherein said signal processing circuit is to receive image data, to determine an average luminance in the image data, and to electrically control the luminance level of each of the light sources based on the determined average luminance.

2. A field sequential liquid crystal display device according to claim 1, wherein the light sources include Red, Green and Blue.

3. A field sequential liquid crystal display device according to claim 1, wherein each light source is disposed at a lower corner of the liquid crystal panel.

4. A field sequential liquid crystal display device according to claim 1, wherein each light source is disposed under the liquid crystal panel.

5. A field sequential liquid crystal display device according to claim 1, further including a panel for uniformly dispersing light from the back light onto the liquid crystal panel.

6. A field sequential liquid crystal display device according to claim 1, wherein said signal processing circuit is further for controlling the transmissivity of the liquid crystal such that a perceived luminance of the field sequential liquid crystal display device during a frame is dependent on average luminances in the image data.

7. A field sequential liquid crystal display device according to claim 6, wherein the transmissivity of the liquid crystal is controlled by turning on thin-film transistors during sub-frames.

8. A field sequential liquid crystal display device according to claim 7, wherein the light sources are turned on and off during each sub-frame while thin-film transistors are turned on.

9. A field sequential liquid crystal display device according to claim 1, wherein said signal processing circuit is for receiving image data, for determining an emphasized color in the image data, and for electrically controlling the luminance of at least one light source to produce an image having the emphasized color in the image data is emphasized.

10. A field sequential liquid crystal display device according to claim 9, wherein the light sources are turned on and off during sub-frames.

11. A field sequential liquid crystal display device according to claim 9, wherein said signal processing circuit is further for controlling the transmissivity of the liquid crystal to emphasize the emphasized color in the image data.

12. A method of displaying color image using a field sequential liquid crystal display device having upper and lower substrates, an interposed liquid crystal layer, and a back light having Red, Green, and Blue light sources, the method comprising the steps of:

converting frame-based image signal data into luminance values Ra, Ga, and Ba that are to be produced during sub-frames of each frame period, wherein each sub-frame is one-third of a frame period; and driving the Red, Green, and Blue light sources in sequential sub-frames so as to produce respective luminances Ra, Ga and Ba, wherein Ra, Ga and Ba are in accord with the following:

$$Rx\times(Tr\times Tk)=Ra$$

$$Gy\times(Tg\times Tk)=Ga$$

$$Bz\times(Tb\times Tk)=Ba$$

where Tr, Tg, and Th are transmissivities of the liquid crystal, Rx, Gy, and Bz are luminances of the light sources, and Tk is a transmissivity of the liquid crystal panel.

13. The method according to claim 12, wherein the alignment direction of liquid crystal molecules and the luminance of the light source of the back light can be controlled by varying an electric current.

14. The method according to claim 12, wherein the liquid crystal is aligned in each sub-frame, and wherein an associated light source is turned on and off while the liquid crystal is aligned in each sub-frame.

15. The method according to claim 12, wherein the luminances Ra, Ga and Ba are average luminance values.

16. The method according to claim 12, wherein the luminances Ra, Ga and Ba are produced by controlling both the liquid crystal alignment and the light source luminances.

17. The method according to claim 12, wherein if one of the luminances Ra, Ga, and Ba is greater than an average value of the Ra, Ga, and Ba, the transmissivity of the liquid crystal and the luminance of the light source at the sub-frame displaying an image having the bigger luminance is set as a maximum value.

18. The method according to claim 12, wherein the liquid crystal alignment and the luminance of the light source of the back light can be controlled by varying an electric signal.

19. A field sequential liquid crystal display device, comprising:

a liquid crystal panel having an upper substrate, a lower substrate, and an interposed liquid crystal layer;

a data input driver;

a back light under the lower substrate for irradiating light onto the liquid crystal panel, said back light including at least three light sources; and a signal processing circuit connected to an output of the data input driver and to the light sources, wherein the signal processing circuit is to directly control a luminance level of each of the light sources based upon image data from the data input driver, wherein said signal processing circuit is to receive image data, to determine an average luminance in the image data, and to electrically control the luminance level of each of the light sources based on the determined average luminance, and wherein the light sources of the backlight are turned on and off during sub-frames.

* * * * *